US006032318A

United States Patent [19]

McLaughlin et al.

[11] Patent Number: 6,032,318

[45] Date of Patent: Mar. 7, 2000

[54] APPARATUS FOR DRYING HARD FLOORS

[76] Inventors: Hugh Rogers McLaughlin, Aberdour Bray Road, Foxrock, Dublin 18; Oliver Hood, Hood Associates, Merrion Square, Dublin 2; John Callaghan, 4 Mountain View, Naas, County Kildare, all of Ireland

[21] Appl. No.: 09/000,348

[22] PCT Filed: Jul. 19, 1996

[86] PCT No.: PCT/IE96/00044

§ 371 Date: May 11, 1998

§ 102(e) Date: May 11, 1998

[87] PCT Pub. No.: WO97/03598

PCT Pub. Date: Feb. 6, 1997

[30] Foreign Application Priority Data

Jul. 21, 1995 [IE] Ireland ..... S950556

[51] Int. Cl.[7] ..... A47L 13/20

[52] U.S. Cl. ..... 15/228; 15/231

[58] Field of Search ..... 15/98, 103.5, 228, 15/230, 230.11, 231, 233

[56] References Cited

U.S. PATENT DOCUMENTS

| | | | |
|---|---|---|---|
| 899,726 | 9/1908 | Goodier | 15/228 |
| 1,130,064 | 3/1915 | Buchanan | 15/228 |
| 1,473,146 | 11/1923 | Forcier | 15/228 |
| 2,452,744 | 11/1948 | Gardner | 15/228 |
| 2,690,582 | 10/1954 | Sundell | 15/228 |
| 3,116,504 | 1/1964 | Unterbrink et al. | 15/231 |
| 3,916,470 | 11/1975 | May | 15/98 |
| 4,121,315 | 10/1978 | Buser | 15/228 |
| 4,510,642 | 4/1985 | Ingermann et al. | 15/228 |

*Primary Examiner*—Terrance R. Till
*Attorney, Agent, or Firm*—Michael G. Petit

[57] ABSTRACT

An apparatus for drying a hard floor comprises a frame and first and second rollers mounted in the frame for rotation about substantially parallel axes. The first roller has a continuous roll of absorbent sheet material mounted thereon whose free end is attached to the second roller such that the sheet material may be drawn from the first roller to become wound on the second roller. A part of the sheet material at the periphery of each roll is exposed for contact with the floor.

20 Claims, 6 Drawing Sheets

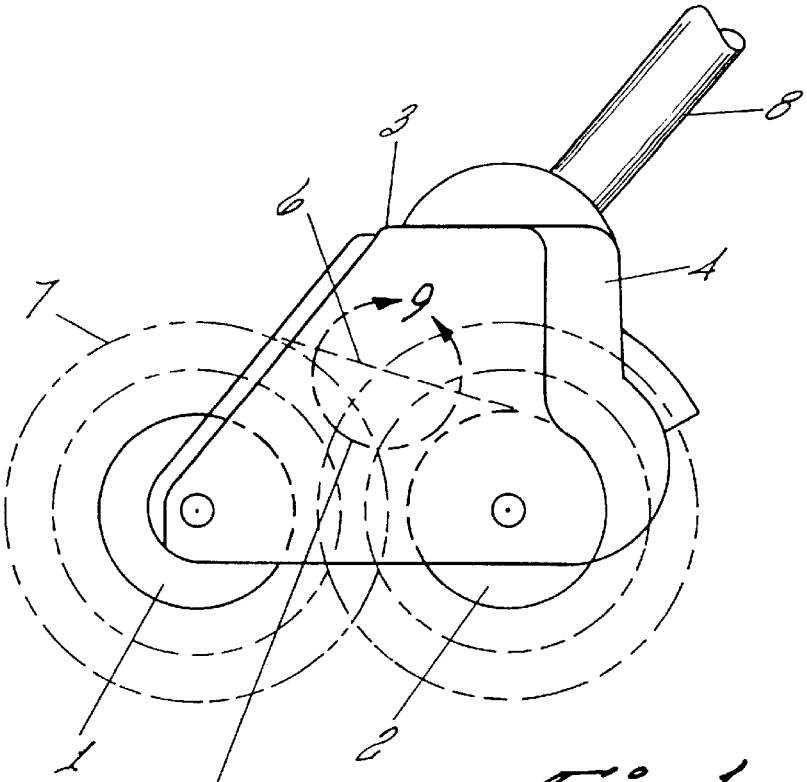
Fig 1
Fig 9
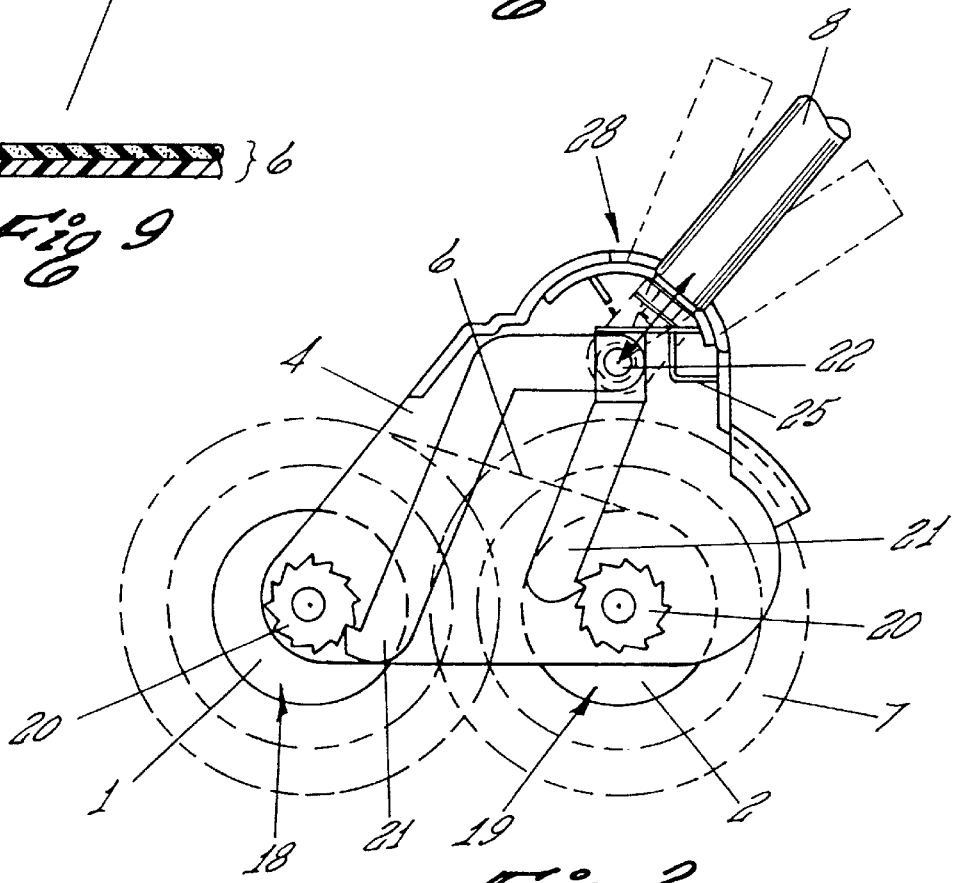
Fig 2

APPARATUS FOR DRYING HARD FLOORS

BACKGROUND OF THE INVENTION

1. Field of the Invention

This invention relates to an apparatus for drying hard floors such as those made of tiles, ceramics or plastics.

2. Prior Art

Hard floors, such as floors made of tile, ceramic or plastics, after being washed or after the removal of liquid spillage, still remain slipper to the extent that persons walking on them are liable to slip and injure themselves. Thus public places with tiles floors such as supermarkets, airports, toilets and restaurants are often cordoned off for a considerable time after such spillages or after washing.

3. Summary

It is an object of the invention to provide an apparel for drying hard floors by removing the thin layer or residue of water which floor mops and like devices leave on the floor after washing or spillage removal.

Accordingly, the present invention provides an apparatus for drying a hard floor comprising a frame and first and second rollers mounted in the frame for rotation about substantially parallel axes, the first roller having a continuous roll of absorbant sheet material mounted thereon whose free end is attached to the second roller such that the sheet material may be drawn from the first roller to become wound on the second roller by rotation of the second roller, a part of the sheet material being exposed for contact with the floor.

Embodiments of the invention will now be described, by way of example, with reference to the accompanying drawings, in which:

BRIEF DESCRIPTION OF THE DRAWINGS

FIG. 1 is a side view of a first embodiment of an apparats for drying a hard floor according to the invention, FIG. 2 is a detailed side view of the apparatus of FIG. 1, FIG. 9 is a enlarged cross-sectional view of the sheet material adapted for use with the apparatus of FIG. 4.

DESCRIPTION OF THE PREFERRED EMBODIMENTS

Figure 3:
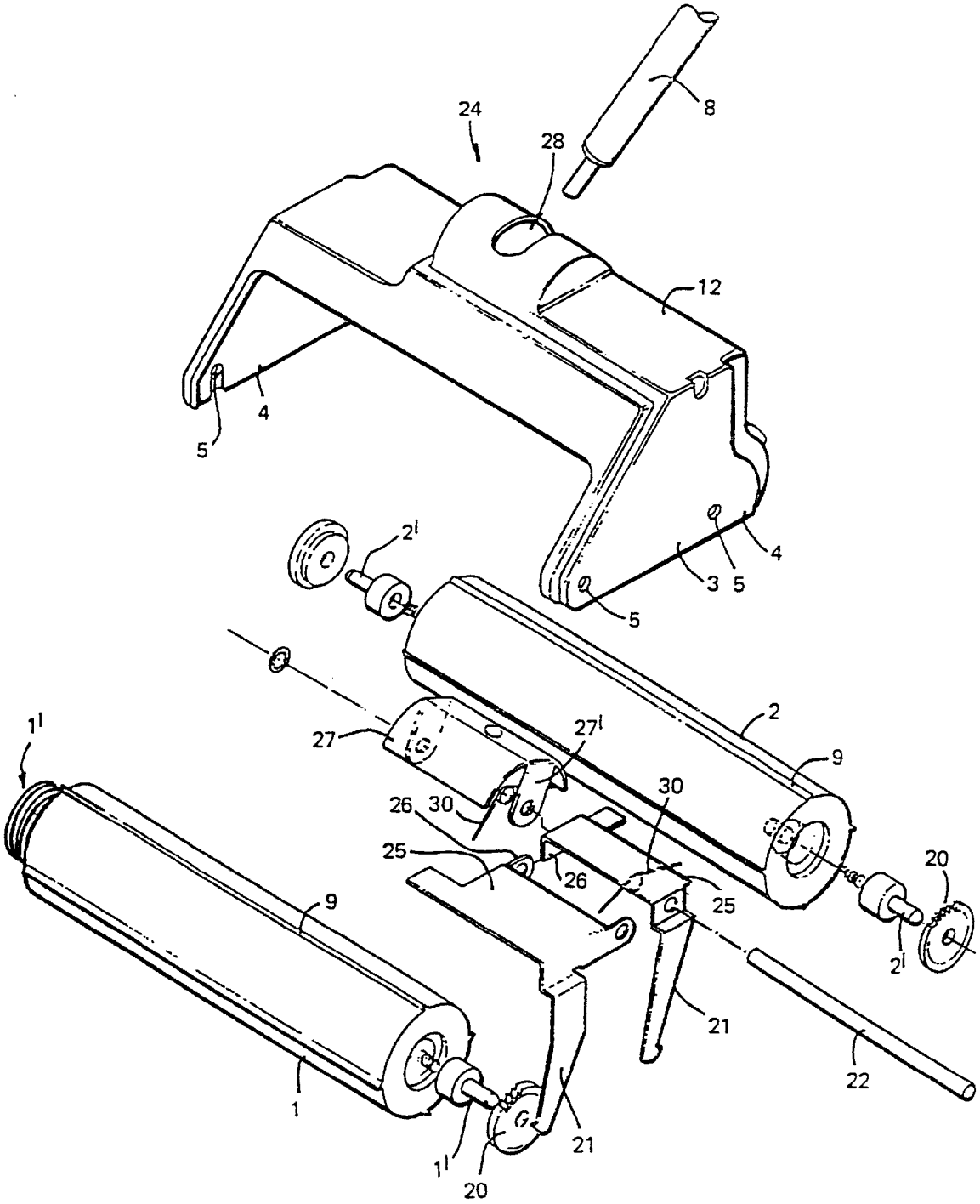
FIG. 3 is an exploded perspective view of the apparatus of FIG. 1 omitting the sheet material.

Referring now to FIGS. 1 to 3 of the drawings, the apparatus has a front supply roller 1 and a rear take-up roller 2. The rollers 1 and 2 are removably mounted in a plastics frame 3 for rotation about substantially parallel axes. The frame 3 has substantially parallel side arms 4 joined by a bridge section 12. Each roller 1, 2 has a pair of coaxial stub shafts 1', 2' respectively fined into recesses at each end of the roller, and these are a snap fit into respective apertures 5 in the corresponding side arm 4 of the frame 3 The rollers 1, 2 are preferably made of plastics material.

A continuous length of highly absorbant sheet material 6 is mounted on the supply roller 1 in a roll 7. The free end of the material 6 is attached to the take-up roller 2 such that the sheet material may be drawn from the supply roller 1 to become wound on the take-up roller 2 by rotation of the latter as will be described. FIGS. 1 and 2 show the situation where the sheet material 6 from the supply roller 1 has been partially wound onto the take-up roller 2, forming a similar roll 7 on that roller.

The sheet material 6 is preferably wound around a cylindrical cardboard core (not shown), which is then slid over the roller 1. A plurality of ribs 9 of triangular cross-section run along the length of the roller 1, FIG. 3, to provide an interference fit between the internal surface of the core and the roller 1, thus preventing rotation of the core around the roller 1 when in use.

The sheet material 6 may be a highly absorbent tissue paper similar to but heavier than that used on paper towels, but any other material, such as that made from a combination of cellulose fibre and polypropylene, which has highly absorbent qualities, may be used. A particularly advantageous form of material which may be used is that sold by Kimberley Clark under the trade names HYDROKNIT or WORKHORSE. Alternatively, one could use a cotton clot toweling or other suitable textile or material comprising approximately 70% viscose/30% polyester.

In order to reduce or eliminate the danger of water seeping into an unnecessary depth of the absorbent paper or other sheet material 6, a continuous waterproof backing sheet of, for example, relatively non-absorbent paper may be interwebbed between the layers of material on the roll 7 so as to be adjacent the surface of the sheet material opposite the floor-contacting surface. Alternatively, a waterproof coating may be provided on the surface of the sheet material opposite the floor-contacting surface. This preferably comprises a layer of polyethylene in an amount of 20% by weight of the sheet material.

In use, a full roll 7 of the absorbant sheet material 6 is fitted on the roller 1 and the later loaded onto the frame 3 by snap fitting the ends of its stub shafts 1' into the appropriate apertures 5 in the side arms 4 of the frame 3. The free end of the material 6 is fitted to a second, empty core (not shown) which is fitted to the take-up roller 2 before the roller 2 is fitted to the frame 3. Alternatively, the free end of the material 6 can be manually pulled out from the roller 1 and fixed to the empty take-up roller 2 adapted to include a slot or other means to retain the end of the sheet material.

Now, the frame 3 is moved back and forth across the wet area of floor, so that the rollers 1 and 2, locked agent rotation in the frame 3 as will be described, slide back and for across the floor and absorb the layer of water or other liquid remaining on it from previous mopping. To this end the frame 3 has an elongate handle 8 such that the frame 3 may be manipulated to move the apparatus over the floor by a stag operator. The handle 8 is pivotted to the frame 3 for angular movement substantially in a plane normal to the axes of the rollers 1 and 2, as indicated in FIG. 2.

Drying is effected by the material 6 exposed at the circumference of the rolls 7 of material on the rollers 1, 2. The rolls 7 flatten slightly under the weight of the apparatus to provide for a flat section of material 6 to contact the floor, thereby providing a sufficiently large area of material to absorb water from the ground at any given time.

The supply and take-up rollers 1 and 2 are releasably locked against rotation during use of the apparatus for drying a floor by respective ratchet mechanisms 18 and 19 associated with the rollers 1 and 2. Each ratchet mechanism comprises a ratchet wheel 20 fixed to the respective roller 1 or 2 and a respective pawl arm 21 mounted within the frame 3 for cooperation with each wheel 20. As will be described, each pawl arm 21 is normally biased into engagement with the respective ratchet wheel 20. The arm 21 of the mechanism 18, when engaged with its ratchet wheel 20, permits the roller 1 to rotate only in an anti-clockwise direction as seen in FIGS. 1 and 2. The arm 21 of the mechanism 19, when engaged wit us ratchet wheel 20, permits the roller 2 to rotate only in a clockwise direction. Thus when both pawl arms 21 are so engaged and the sheer material 6 is taut between the rollers the material 6 cannot be unwound from either roller, tension is maintained in the material 6 and neither roller 1 or 2 is able to rotate to a significant extent.

When the material 6 becomes wet, the pawl arm 21 associated with one of the rollers is disengaged from its respective ratchet wheel 20, which permits the other roller to be rotated to draw material off he first roller. For example, to draw fresh material from the roller 1 the pawl arm 21 associated therewith is disengaged from its respective wheel 20 and the roller 2 is rotated in a clockwise direction.

Thus, the direction of travel of the sheet material 6 depends upon which pawl arm is disengaged. Normally, of course, the material 6 is moved in the direction of the take-up roller 2 until the suppler roller 1 is empty and the take-up roller full, after which the material could be re-used by rewinding the material onto the supply roller 1. Each time a fresh area of material 6 is exposed, both pawl arms 21 are returned into engagement with their respective ratchet wheels 20 to stop further rotation of the rollers as the apparatus is slid or wiped across the floor.

To enable selective disengagement of the pawl arms 21 as aforesaid, the pawl arms are pivotally mounted on a common shaft 22 at their ends remote the ratchet wheels 20. One end of the shaft 22 is mounted in an aperture 23 in the side wall 4 of the frame 3. A step 24 is formed in the bridge section 12 towards the opposite side wall of the frame, and the other end of the shaft 22 is mounted in a recess (not shown) formed in the side of the step 24. Each pawl arm 21 is integral with and bent downwardly from a respective deflection plate 25 which extends above and along the length of the shaft 22. At its opposite ends each plate 25 is bent over to form a respective flap 26 in which a hole is formed to accommodate the shaft 22.

A selector plate 27 of umbrella cross-section is pivotally mounted on the shaft 22 over the deflection plates 25 by means of downwardly extending flaps 27' at its opposite ends which have respective apertures through which the shaft 22 passes. The end of the handle 8 passes through a slot 28 formed in the bridge section 12 and is fixed to the selector plate 27. With the end of the handle 8 located towards the middle of the slot 28 each edge of the selector plate is spaced from the deflection plates 25. The pawl arms 21 are biassed into contact with their respective ratchet wheels 20 by coil springs 30 mounted over the shaft 22 and under the deflection plates 25, urging the pawl arms 21 mutually away from one another and into contact with the ratchet wheels 20.

When an operator wishes to draw fresh material 6 from the supply roller 1, the operator pushes down on the handle 8 and draws the apparatus backwards, causing the supply roller 1 to be cocked in the air away from the floor. This causes the handle 8 to pivot in the direction of the supply roller 1 within the slot 28, thus bringing the selector plate 27 into contact with the deflector plate 25 of the mechanism 18. The associated pawl arm 21 is thus disengaged from its ratchet wheel 20, to allow the backwards movement of the apparatus to cause clockwise movement of the take-up roller 2 which then draws material from the free rolling supply roller 1.

When all the material 6 from the supply roller 1 has wound onto the take-up roller 2, the apparatus is turned over so that the roller 1 is brought into contact with the floor and the roller 2 is disposed substantially vertically above the roller 1. Pulling the apparatus towards the user causes the handle 8 to pivot in the direction of the take-up roller 2 wit the slot 28, thus bringing the selector plate 27 into contact with the deflector plate 25 of the mechanism 19. The associated pawl arm 21 is thus disengaged from its ratchet wheel 20, to allow the movement of the apparatus to cause the supply roller 1 to rotate and draw material from the free rolling take-up roller 2. The roll of material 6 can then be re-used, by moving the material back from roller 1 to roller 2 as described earlier.

Re-using the material is possible because tests have shown that wet absorbent paper used as the material 6 will dry out under normal indoor conditions, particularly as each roll should last typically for 1 week. This will therefore cut down the cost of the paper by 50% compared to a single run and also cut the time spent in changing rolls by one half.

Once the material becomes too soiled, the full roll 7 on the make-up roller 2 can be disposed of. The rolls of material 6 may be supplied to the user of the apparatus on ready to use replaceable rolls, on a weekly collection/delivery laundry service.

FIGS. 4 to 8 illustrate a second embodiment of The invention, in which the same reference numerals have been used for pars the same or equivalent to parts of the first embodiment. The second embodiment operates in essentially the same manner as the first except as now to be described.

A first, minor difference is that instead of the handle 8 (not shown in FIG. 4) passing through a single slot 28 in the bridge 12, the handle 8 is bifurcated at its lower end and each bifurcation passes through a respective slot 28'. Within the frame 3 the lower end of each bifurcation is fixed to the selector plate 27. Otherwise the manner in which rotation of the handle relative to the frame selectively disengages the pawl arms is the same as previously described.

Figure 5:
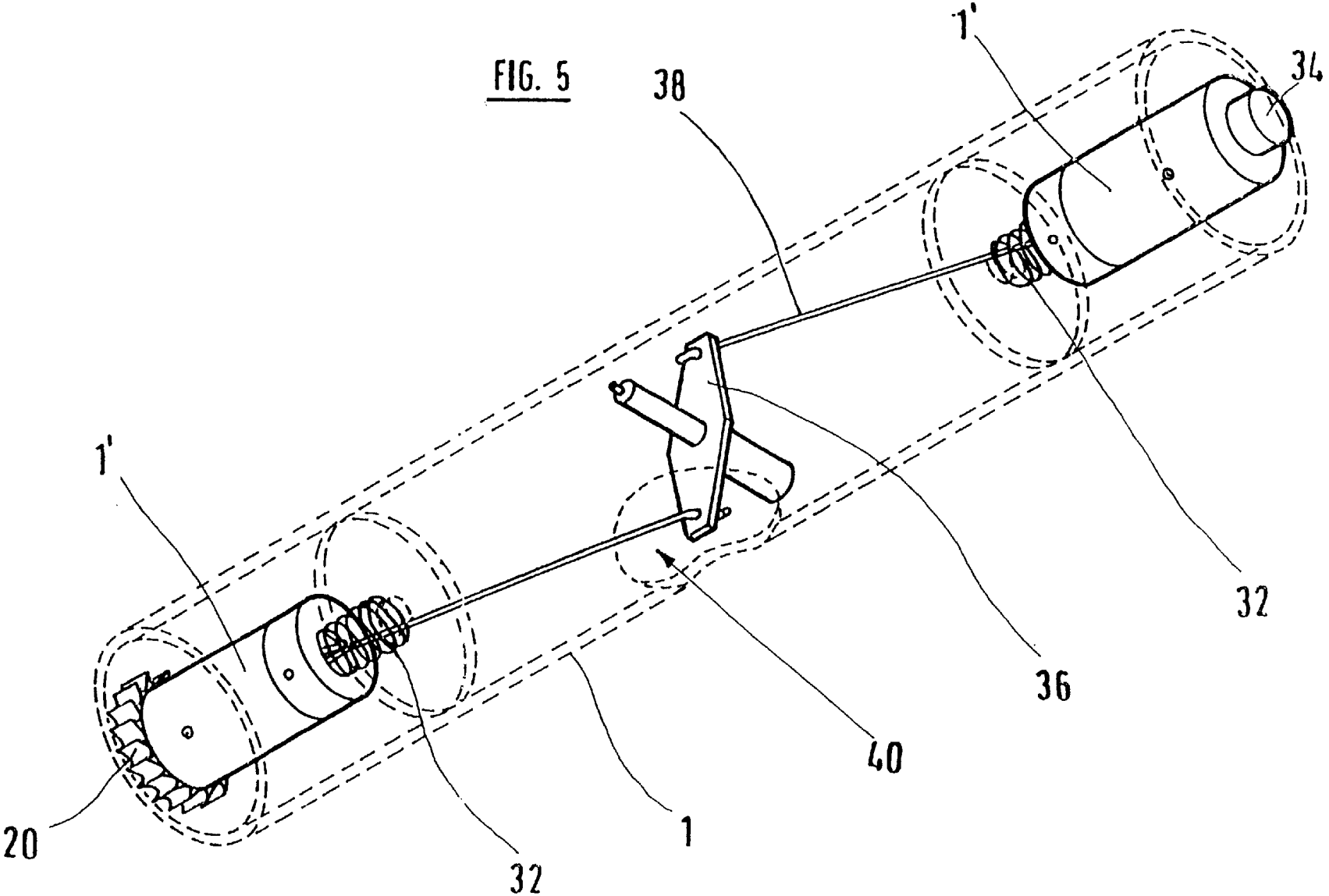
FIG. 5 shows the ingenue construction of one of the rollers of the apparatus of FIG. 4.

A further difference lies in the construction of the rollers 1 and 2, as seen in FIG. 5 (FIG. 5 shows the roller 1, but the construction in the same for roller 2). In the first embodiment the stub shafts 1', 2' were fixed in the ends of the rollers and the frame 3 had to be distorted slightly in order to enable the rollers to snap into the apertures 5. In the present embodiment the stub shafts 1' are movable axially of the roller and biassed by springs 32 so that their lesser diameter outer ends 34, which are the parts which actually engage in the recesses 5, project clear of the ends of the roller. Stop means, not shown, limit the degree of emergence of tee stub shafts from the roller.

The stub shafts 1' at the opposite ends of the roller 1 are coupled together by an arm 36 located in middle of the roller and pivotted at its centre for rotation about a transverse axis. Each stub shaft 1' is coupled to an opposite end of the arm by a respective tie rod 38. To fit the roller into the apertures 5 the stub shafts 1' are first retracted into the roller 1 against their spring bans, either by pushing one stab shaft into the roller whereupon the other is automatically retracted into the roller by rotation of the arm 36, or by accessing and rotating the arm 36 through an aperture 40 in the side of the roller. The roller is then offered to the frame so that the ends 34 of the stub shafts 1' are aligned with the respective apertures 5, and the stub shafts released. To remove a roller, the arm 36 is accessed through the aperture 40 and rotated in the appropriate direction to retract the stub shafts. This allows a more robust and rigid frame 3 to be used Than in the first embodiment.

Figure 6:
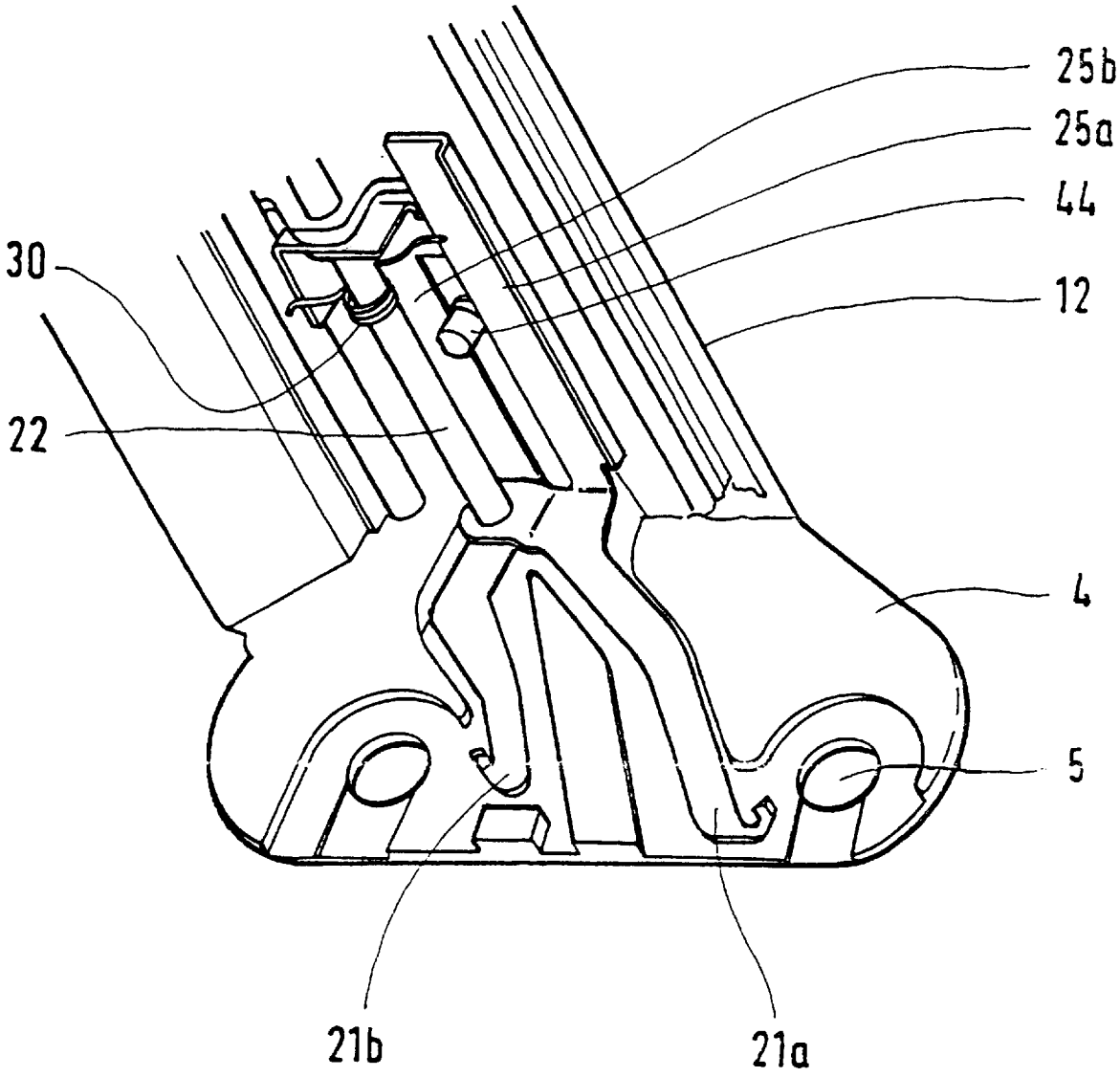
FIG. 6 shows the pawl mechanism of the apparatus of FIG. 4.
Figure 8:
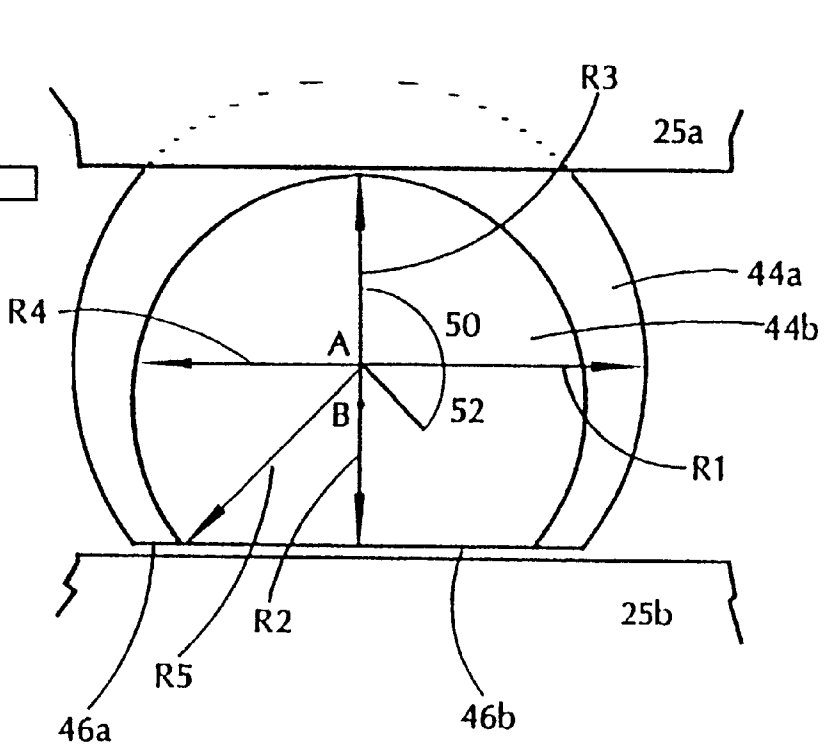
FIG. 8 is an underneath plan view of the cams of the apparats of FIG. 4.
Figure 7:
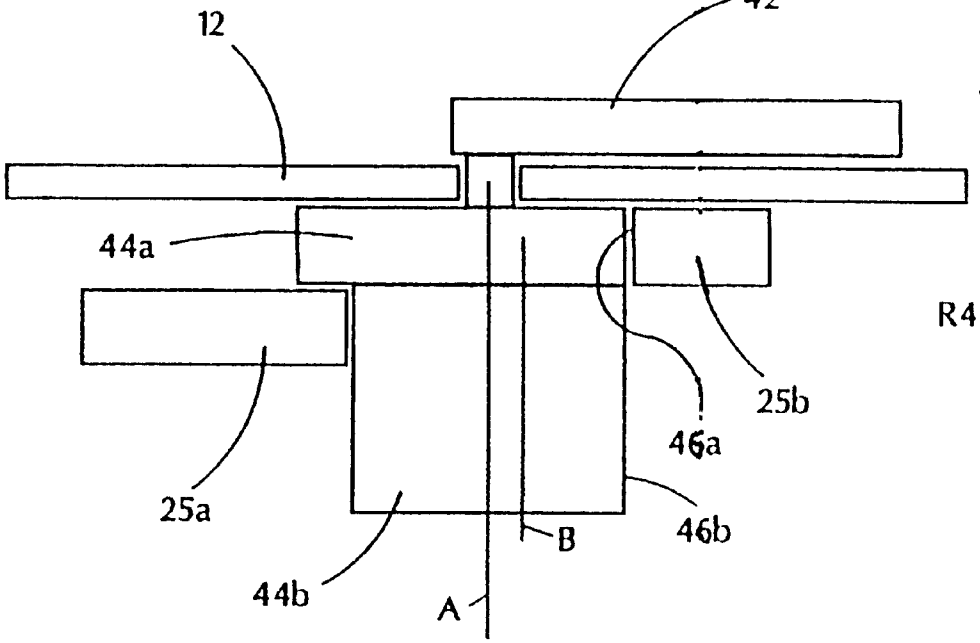
FIG. 7 is a cross-section through the pawl actuating lever and cams of the apparatus of FIG. 4.

A third difference is that a lever-operated cam mechanism (see especially FIGS. 7 and 8) is provided to operate the pawl arms 21, in addition to the handle-operated mechanism described earlier. In FIGS. 6 to 8 the front and rear pawl arms 21 are separately identified as 21*a* and 21*b* respectively, and their associated deflector plates are likewise identified as 25*a* and 25*b* respectively, The cam mechanism comprises a lever 42 mounted on top of the bridge section 12 of the frame 3 for rotation through almost 180 degrees about an axis A, FIGS. 7 and 8. Beneath the bridge section 12 the lever 42 is rigidly connected to a cam 44 for rotation with the lever, the cam having upper and lower cam sections 44*a* and 44*b* respectively. Each cam section is circular except that they have coplanar flats 46*a* and 46*b* respectively. The centre of the upper cam section 44*a* is on the axis A, while the centre of the lower cam section 44*b* is offset from the axis A towards the flats 46*a*, 46*b* to lie on an axis B parallel to the axis A. As seen in FIGS. 6 to 8 the inner edges of the front and rear deflection plates 25*a* and 25*b* are biassed by the spring 30 into engagement with opposite sides of the cam 44, and act as cam followers. In particular the inner edge of the front deflector plate 25*a* is biased against the lower cam section 44*b*, while the inner edge of the rear deflector plate 25*b* is biased against the upper cam section 44*a*.

Figure 4:
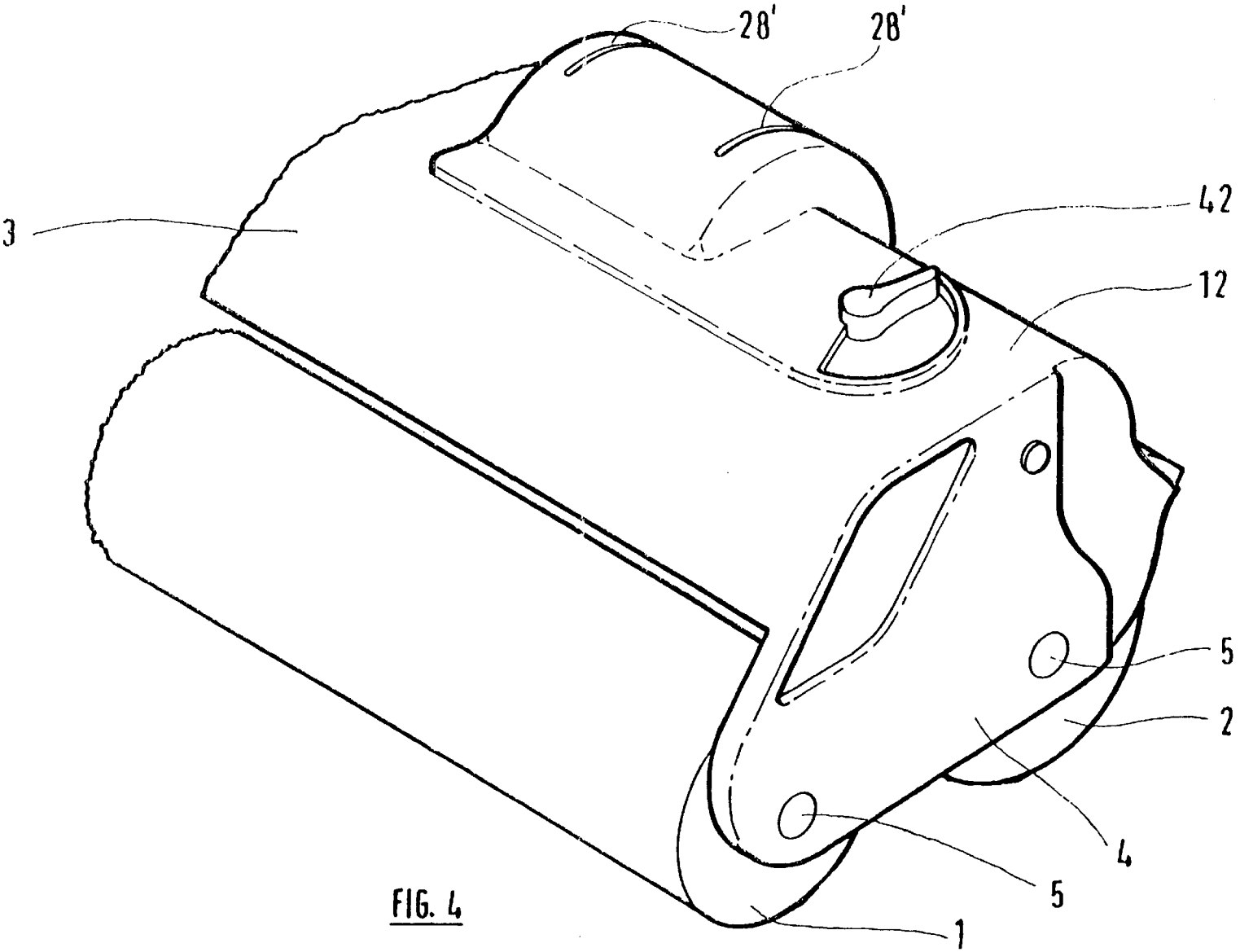
FIG. 4 is a perspective view of a second embodiment of the invention, omitting the handle.

With the lever 42 in the position shown in FIG. 4 the cam 44 is in the orientation shown in FIGS. 7 and 8 with the inner edge of the front deflection plate 25*a* engaging the lower cam section 44*b* diametrically opposite the flat 46*b* and the inner edge of the rear deflection plate 25*b* engaging the flat 46*a* of the upper cam section 44*a*. In this position the inner edges of the front and rear deflection plates 25*a* and 25*b* are at their closest approach and the pawl arms 21*a*, 21*b* engage their respective ratchet wheels 20. Thus the rollers 1, 2 are locked against rotation as previously described.

If the lever is rotated through 90 degrees from the position shown in FIG. 4, as indicated by the arrow 50 in FIG. 8, the cam 44 likewise rotates through the same angle. This brings the inner edge of the rear deflection plate 25 onto the circular part of the periphery of the upper cam section 44*a*, displacing it significantly outwardly against the bias of the spring 30, by the amount R1–R2 (FIG. 8), so that the corresponding pawl arm 21*b* is disengaged from its ratchet wheel 20. However, the corresponding outward movement of the inner edge of the front deflection plate 25*a*, R4–R3, is too small to disengage its pawl arm 21*a* from its ratchet wheel 20. This allows the apparatus to be rolled towards the user on a floor to draw fresh sheet material from the front roller 1 onto the rear roller 2, and provides an alternative to using the handle 8 for this purpose as described above. now the lever is firer rotated in the same direction through a further angle 52 to the limit of its rotation, the cumulative outward movement R5–R3 of the front deflection plate 25*a* is now sufficient to disengage its pawl arm 21*a* from the associated ratchet wheel. Now both pawl arms 21*a* and 21*b* are disengaged from their ratchet wheels 20, allowing the rollers 1 and 2 to be removed.

Apart from removing water from hard floors, the apparatus described above may be used for removing spillages of oil, for example, from floors of engineering workshops and diesel oil from garage forecourts. It can also be used to absorb water or other liquids from carpets or other soft floor furnishings.

The apparatus also facilitates the washing of a floor area without requiring large amounts of water. For example, a user may spray a relatively small amount of liquid detergent onto the floor area which is then removed together with any dirt material from the floor as well as drying the floor area. This is a particularly advantageous feature of the invention which enables floors to be cleaned and dried very quickly with a single apparatus.

The invention is not limited to the embodiments described herein which may be modified or varied without departing from the scope of the invention.

What we claim is:

1. An apparatus for drying a hard floor comprising a frame and first and second rollers mounted in the frame for rotation about substantially parallel axes, the first roller having a continuous roll of absorbent sheet material mounted thereon and having a free end which is attached to the second roller such that the sheet material may be drawn from the first roller to become wound on the second roller by rotation of the second roller a part of the sheet material being exposed for contact with the floor, means operative at least when the sheet material extends tautly between the rollers for releasably locking the rollers against rotation, wherein the releasable locking means comprises means for preventing rotation of each roller in a direction opposite to that tending to draw sheet material from the other roller and wherein the releasable locking means comprises a respective ratchet wheel fixed to each roller and a respective pawl member carried by the frame associated with each ratchet wheel, each pawl member being movable between a first position wherein it engages the respective ratchet wheel to prevent rotation of the associated roller in said opposition direction and a second position wherein it disengages the respective ratchet wheel to permit such rotation.

2. An apparatus as claimed in claim 1, wherein either one of the pawl members may be moved into its second position while the other pawl member remains in its fist position, so that the sheet material may be drawn from the first roller to become wound on the second roller by rotation of the second roller or drawn from the second roller to become wound on the first roller by rotation of the first roller.

3. An apparatus as claimed in claim 2, wherein the frame has an elongate handle such that the frame may be manipulated to move the floor-contacting part of the sheet material over the floor by a standing operator, the handle being pivotted to the frame for angular movement substantially in a plane normal to the axes of the rollers, the apparats further including means for selectively causing either one or the other pawl to disengage the respective ratchet wheel according to the angular position of the handle.

4. An apparatus as claimed in claim 1, wherein both of the pawl members may be moved to be in their second positions at the same time.

5. An apparatus as claimed in claim 4, further including a lever-operated cam mechanism mounted on the frame for moving both of the pawl members into their second positions.

6. An apparatus as claimed in claim 5, wherein the lever is movable from a position in which both pawl members engage their respective ratchet wheels either to a position in which only the pawl member associated with the second roller is disengaged from its ratchet wheel or to a position in which both pawl members disengage their respective ratchet wheels.

7. An apparatus as claimed in claim 1, further including a waterproof backing sheet adjacent the surface of the sheet material opposite the floor-contacting surface.

8. An apparatus as claimed in claim 1, further including a waterproof coating on the surface of the sheet material opposite the floor-contacting surface.

9. An apparatus for drying a hard floor, comprising:

a frame;

first and second rollers mounted in the frame for rotation about substantially parallel axes, the first roller having a continuous roll of absorbent sheet material mounted thereon whose free end is attached to the second roller such that the sheet material may be drawn from the first roller to become wound on the second roller, a part of sheet material being exposed for contact with the floor; and releasable locking means operative at least when the sheet material extends tautly between the roller for releasably locking the rollers against rotation, the releasable locking means comprising a respective ratchet wheel fixed to each roller and a respective pawl member carried by the frame associated with each ratchet wheel, each pawl member being movable between a first position wherein it engages the respective ratchet wheel to prevent rotation of the associated roller in the said opposite direction and a second position wherein it disengages the respective ratchet wheel to permit such rotation, and wherein either one the pawl members may be moved into its second position while the other pawl member remains in its first position, so that the sheet material may be one of drawn from the first roller to become wound on the second roller by rotation of the second roller and drawn from the second roller to become wound on the first roller by rotation of the first roller.

10. An apparatus as claimed in claim 9, wherein both of the pawl members may be moved to be in their second positions at the same time.

11. An apparatus as claimed in claim 10, further including a lever-operated cam mechanism mounted on the frame for moving both of the pawl members into their second positions.

12. An apparatus as claimed in claim 11, wherein the lever is movable from a position in which both pawl members engage their respective ratchet wheels either to a position in which only the pawl member associated with the second roller is disengaged from its ratchet wheel or to a position in which both pawl members disengage their respective ratchet wheels.

13. An apparatus as claimed in claim 9, further including a waterproof backing sheet adjacent to the surface of the sheet material opposite the floor-contacting surface.

14. An apparatus as claimed in claim 9, further including a waterproof coating on the surface of the sheet material opposite the floor-contacting surface.

15. An apparatus for drying a hard floor, comprising:

a frame with an elongate handle;

first and second rollers mounted in the frame for rotation about substantially parallel axes, the first roller having a continuous roll of absorbent sheet material mounted thereon whose free end is attached to the second roller such that the sheet material may be drawn from the first roller to become wound on the second roller, a part of sheet material being exposed for contact with the floor, the handle being pivoted to the frame for angular movement substantially in a plane normal to the axes of the rollers, wherein the handle permits the frame to be manipulated to move the floor-contacting part of the sheet material over the floor by a standing operator;

releasable locking means operative at least when the sheet material extends tautly between the roller for releasably locking the rollers against rotation, the releasable locking means comprising a respective ratchet wheel fixed to each roller and a respective pawl member carried by the frame associated with each ratchet wheel, each pawl member being movable between a first position wherein it engages the respective ratchet wheel to prevent rotation of the associated roller in the said opposite direction and a second position wherein it disengages the respective ratchet wheel to permit such rotation, and wherein either one the pawl members may be moved into its second position while the other pawl member remains in its first position, so that the sheet material may be one of drawn from the first roller to become wound on the second roller by rotation of the second roller and drawn from the second roller to become wound on the first roller by rotation of the first roller; and means for selectively causing either one or the other pawl to disengage the respective ratchet wheel according to the angular position of the handle.

16. An apparatus as claimed in claim 15, wherein both of the pawl members may be moved to be in their second positions at the same time.

17. An apparatus as claimed in claim 16, further including a lever-operated cam mechanism mounted on the frame for moving both of the pawl members into their second positions.

18. An apparatus as claimed in claim 17, wherein the lever is movable from a position in which both pawl members engage their respective ratchet wheels either to a position in which only the pawl member associated with the second roller is disengaged from its ratchet wheel or to a position in which both pawl members disengage their respective ratchet wheels.

19. An apparatus as claimed in claim 15, further including a waterproof backing sheet adjacent to the surface of the sheet material opposite the floor-contacting surface.

20. An apparatus as claimed in claim 15, further including a waterproof coating on the surface of the sheet material opposite the floor-contacting surface.

* * * * *